US006286520B1

(12) United States Patent
Lin

(10) Patent No.: US 6,286,520 B1
(45) Date of Patent: Sep. 11, 2001

(54) COSMETIC CONTAINER HAVING A COVER ASSEMBLY PROVIDED WITH A MAGNIFYING EFFECT

(76) Inventor: Yi-Hung Lin, No. 101, Hsi-Chou Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/512,012

(22) Filed: Feb. 24, 2000

(51) Int. Cl.[7] ..... A45D 33/00
(52) U.S. Cl. ..... 132/293
(58) Field of Search ..... 132/293, 294, 132/295, 296, 300, 301, 304, 305, 314, 316; 206/823, 581; 220/212, 377; 215/228, 230

(56) References Cited

U.S. PATENT DOCUMENTS

| | | | | |
|---|---|---|---|---|
| 1,417,333 | * | 5/1922 | Kendall | 132/294 |
| 1,453,249 | * | 4/1923 | Rope | 132/294 |
| 4,545,479 | * | 10/1985 | Figari | 206/51 |
| 5,064,082 | * | 11/1991 | Lombardi et al. | 215/6 |
| 5,431,177 | * | 7/1995 | Kecman | 132/301 |
| 5,669,400 | * | 9/1997 | Sheffler et al. | 132/294 |
| 5,836,319 | * | 11/1998 | Lombardi | 132/294 |
| 6,047,710 | * | 4/2000 | Irving et al. | 132/293 |

FOREIGN PATENT DOCUMENTS

| | | | | |
|---|---|---|---|---|
| 0113137 | * | 5/1951 | (AU) | 132/293 |
| 0710124 | * | 8/1931 | (FR) | 132/293 |
| 2522943-A | * | 9/1983 | (FR) | 206/823 |

* cited by examiner

*Primary Examiner*—Gene Mancene
*Assistant Examiner*—Eduardo C. Robert
(74) *Attorney, Agent, or Firm*—Gilberto M. Villacorta; Corinne M. Pouliquen; Pepper Hamilton LLP

(57) ABSTRACT

A cosmetic container includes a container body and a cover assembly. The container body has a chamber unit to receive cosmetic substances therein. The cover assembly is mounted removably on the container body so as to close the chamber unit. The cover assembly has a cover body unit and a magnifying glass unit that is attached to the cover body unit and that forms enlarged images of the cosmetic substances thereon.

1 Claim, 8 Drawing Sheets

COSMETIC CONTAINER HAVING A COVER ASSEMBLY PROVIDED WITH A MAGNIFYING EFFECT

FIELD OF THE INVENTION

The invention relates to a cosmetic container, more particularly to a cosmetic container having a cover assembly provided with a magnifying effect.

BACKGROUND OF THE INVENTION

Referring to FIGS. 1 and 2, a conventional cosmetic container 1 is shown to include a container body 101 having a chamber unit 103 that is adapted to receive cosmetic substances 104 therein and that is formed with an externally threaded portion 105, and a cover assembly 102 that has an internally threaded portion 106 mounted detachably on the threaded portion 105 of the container body 101 so as to close the chamber unit 103.

Some disadvantages that result from the use of the aforesaid conventional cosmetic container 1 reside in that the cover assembly 102 is monotonous in appearance and cannot enhance aesthetic appeal of the cosmetic substances contained in the container body 101.

SUMMARY OF THE INVENTION

Therefore, the main object of this invention is to provide a cosmetic container having a cover assembly provided with a magnifying effect so as to solve the aforesaid disadvantages that are generally associated with the conventional cosmetic container.

Accordingly, the cosmetic container of the present invention includes a container body and a cover assembly. The container body has a chamber unit that is adapted to receive cosmetic substances therein. The cover assembly is mounted removably on the container body so as to close the chamber unit. The cover assembly has a cover body unit and a magnifying glass unit that is attached to the cover body unit and that is adapted to form enlarged images of the cosmetic substances thereon.

The cover assembly provides enhanced aesthetic appeal of the cosmetic substances received in the chamber unit.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
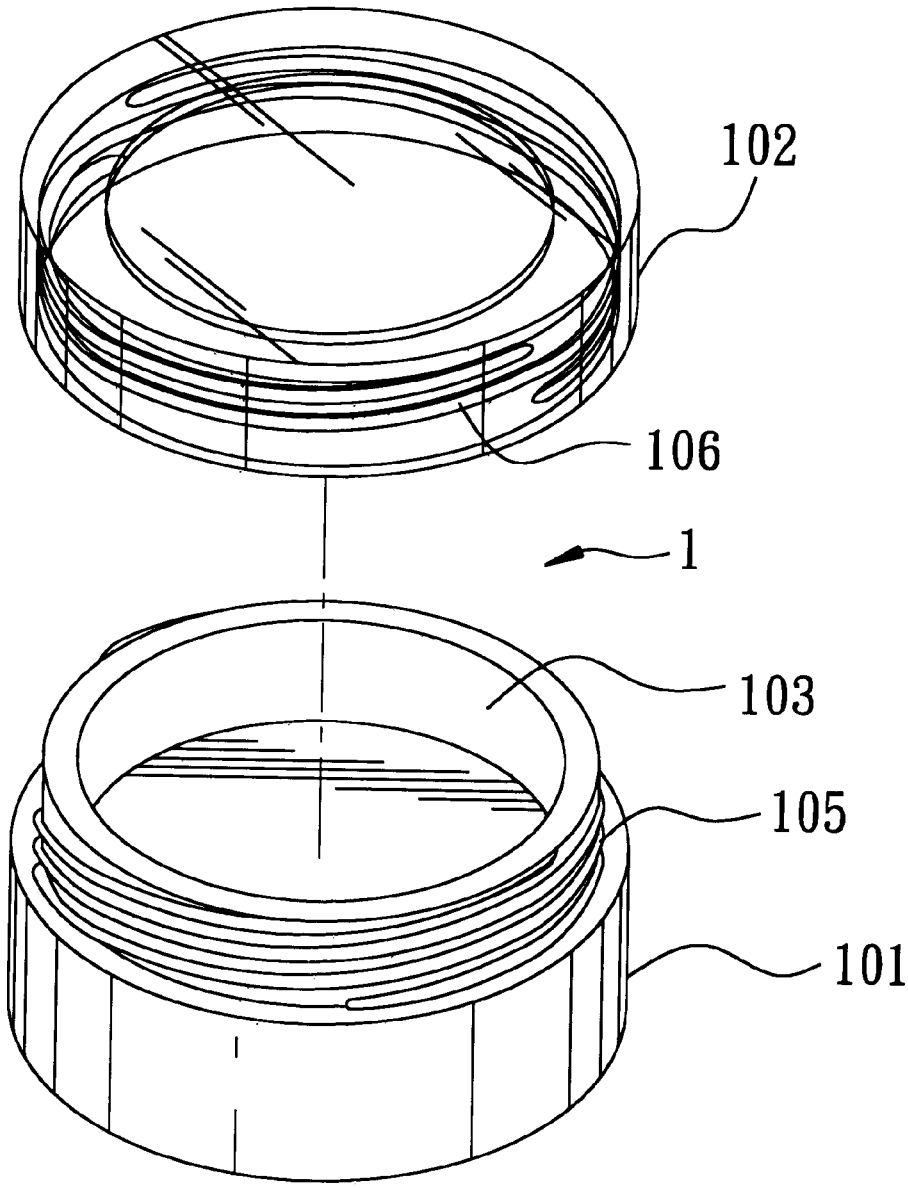
FIG. 1 PRIOR ART
FIG. 1 is an exploded view of a conventional cosmetic container.
Figure 2:
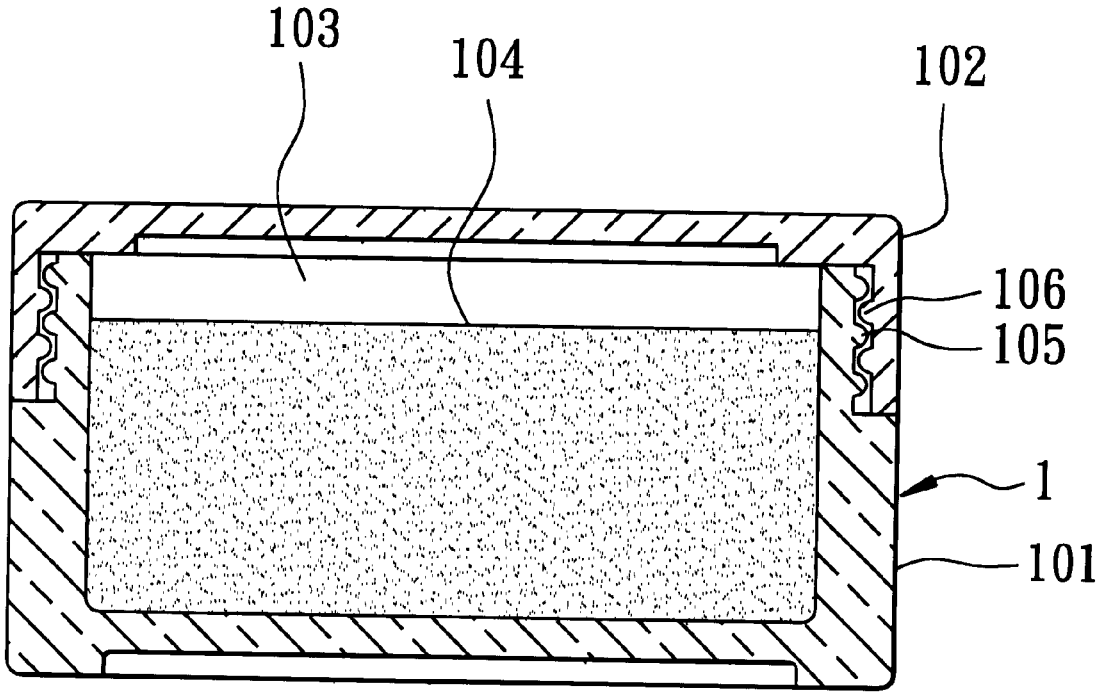
FIG. 2 PRIOR ART
FIG. 2 is a sectional view of the conventional cosmetic container.
Figure 3:
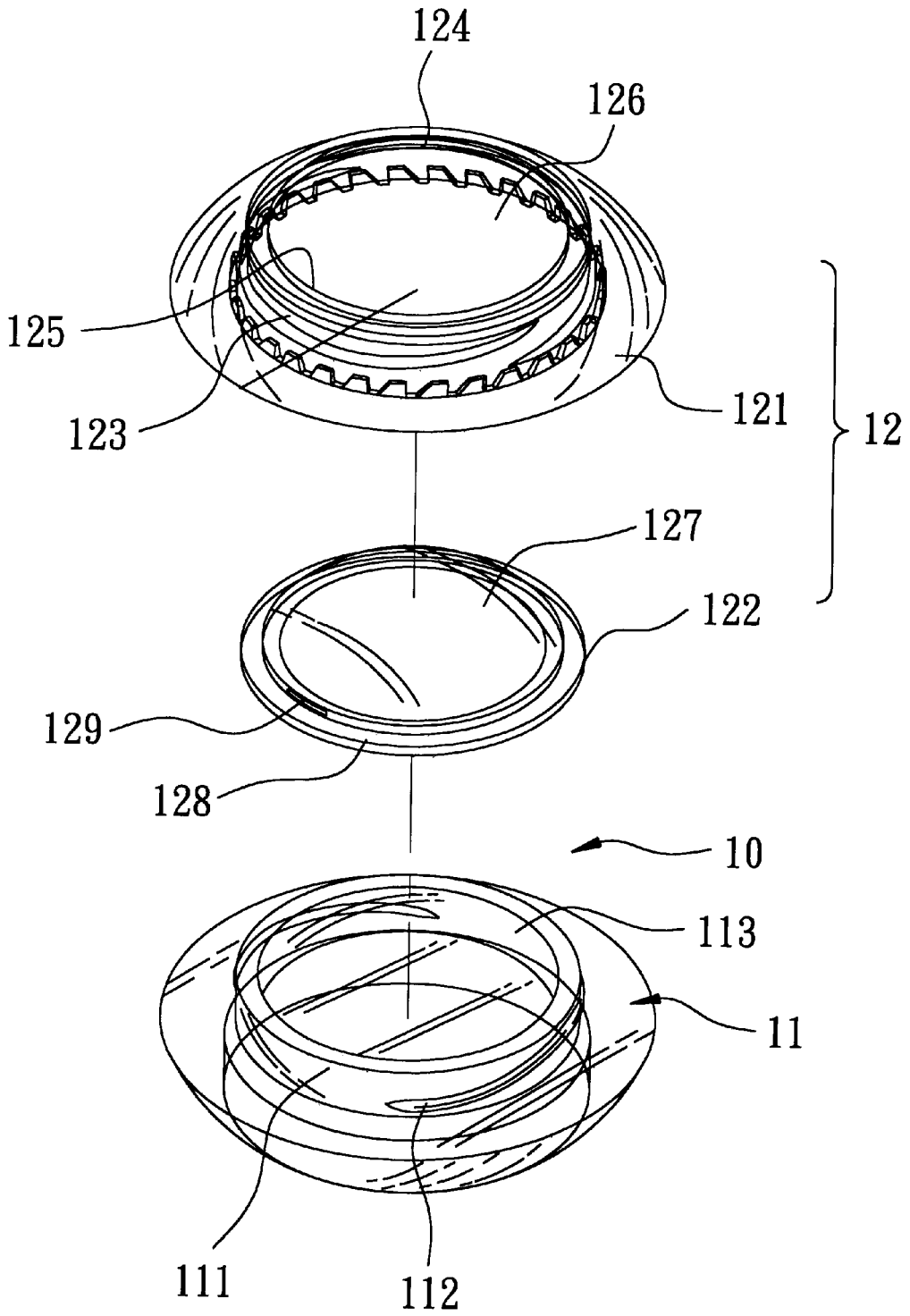
FIG. 3 is an exploded view of the first preferred of a cosmetic container according to the present invention.
Figure 4A:
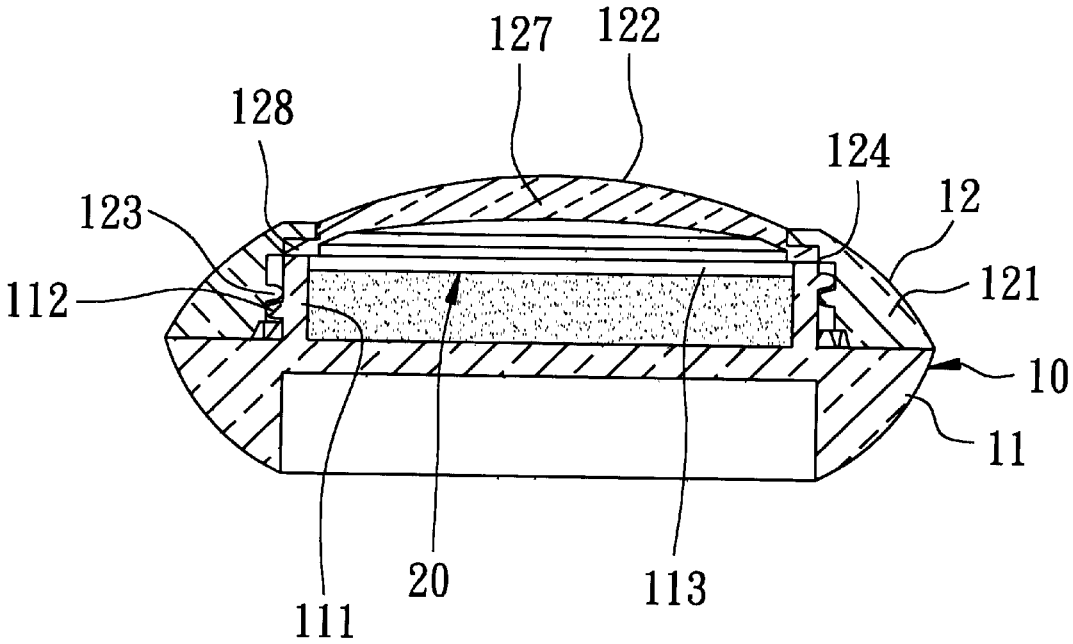
FIG. 4A is a sectional view of the first preferred embodiment.
Figure 4B:
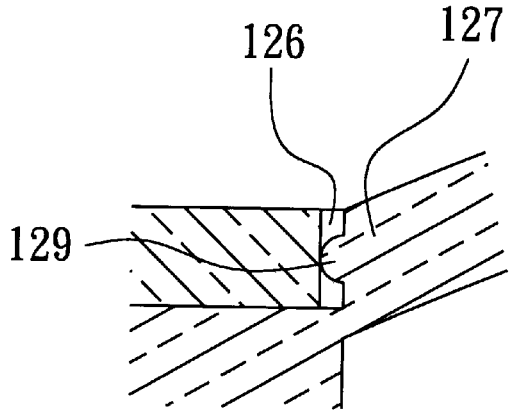
FIG. 4B is a schematic sectional view illustrating a connection between a container body and a cover assembly of the first preferred embodiment.

Referring to FIGS. 3, 4A, and 4B, a first preferred embodiment of a cosmetic container 10 according to the present invention is shown to include a container body 11 and a cover assembly 12.

As illustrated, the container body 11 has a chamber unit 111 that is formed therein and that is adapted to receive cosmetic substances therein, and an externally threaded portion 112.

The cover assembly 12 is mounted removably on the container body 11 so as to close the chamber unit 111. The cover assembly 12 has a cover body unit 121 and a magnifying glass unit 122 that is attached to the cover body unit 121 and that is adapted to form enlarged images of the cosmetic substances thereon.

The chamber unit 111 includes a chamber 113. The cover body unit 121 includes an annular cover body 123 that defines a circular hole 126 therein and that has an open top section 124 with an annular engagement recess 125. The magnifying glass unit 122 includes a circular magnifying glass 127 formed at a central portion thereof and an annular insert section 128 at a peripheral portion thereof. The insert section 128 is press-fitted into the circular hole 126 of the cover body 123 in such a manner that a radially and outwardly extending protrusion 129 of the magnifying glass 127 engages the engagement recess 125 in the cover body 123. When the cover assembly 12 is mounted on the container body 11, the magnifying glass unit 122 of the cover assembly 12 will form enlarged images of the cosmetic substances in the container body 11 so as to enhance consumer appeal.

Figure 5:
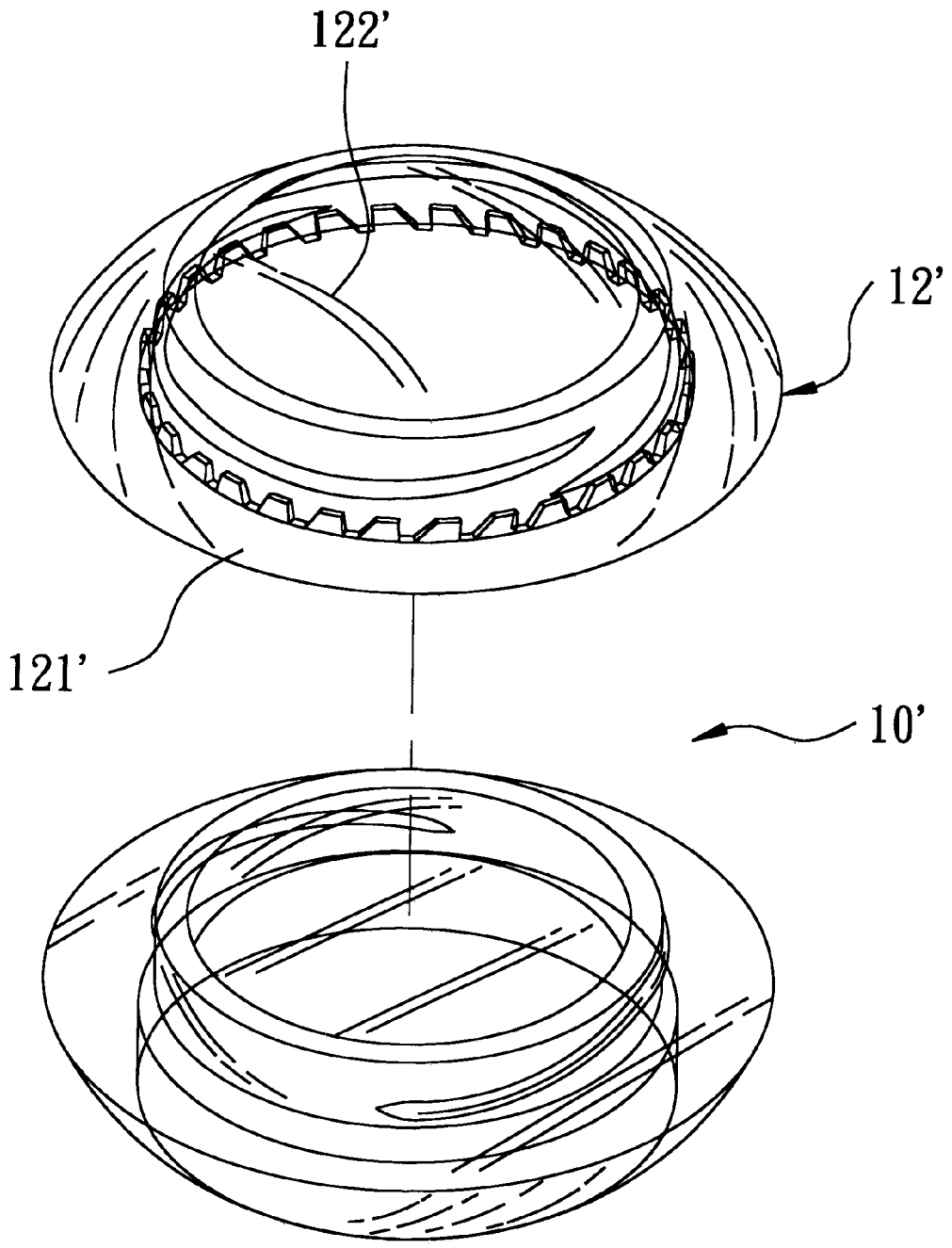
FIG. 5 is an exploded view of the second preferred of a cosmetic container according to the present invention.
Figure 6:
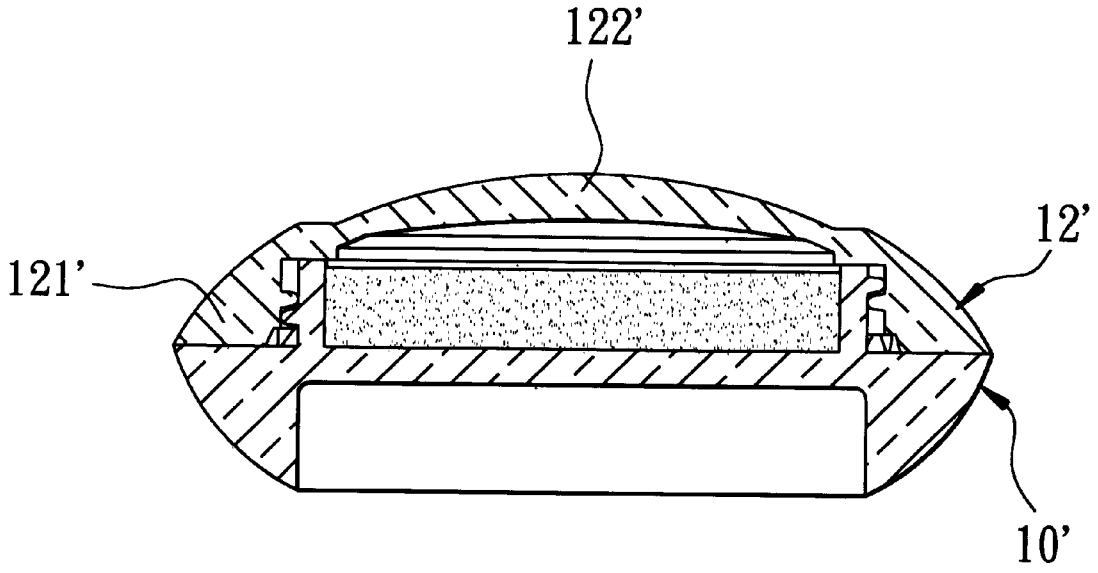
FIG. 6 is a sectional view of the second preferred embodiment.

Referring to FIGS. 5 and 6, a second preferred embodiment of a cosmetic container 10' of the present invention is shown to be similar to the first preferred embodiment in structure, except that the cover assembly 12' has a coverbody unit 121' and a magnifying glass unit 122' integrally formed with the cover body unit 121'.

Figure 7:
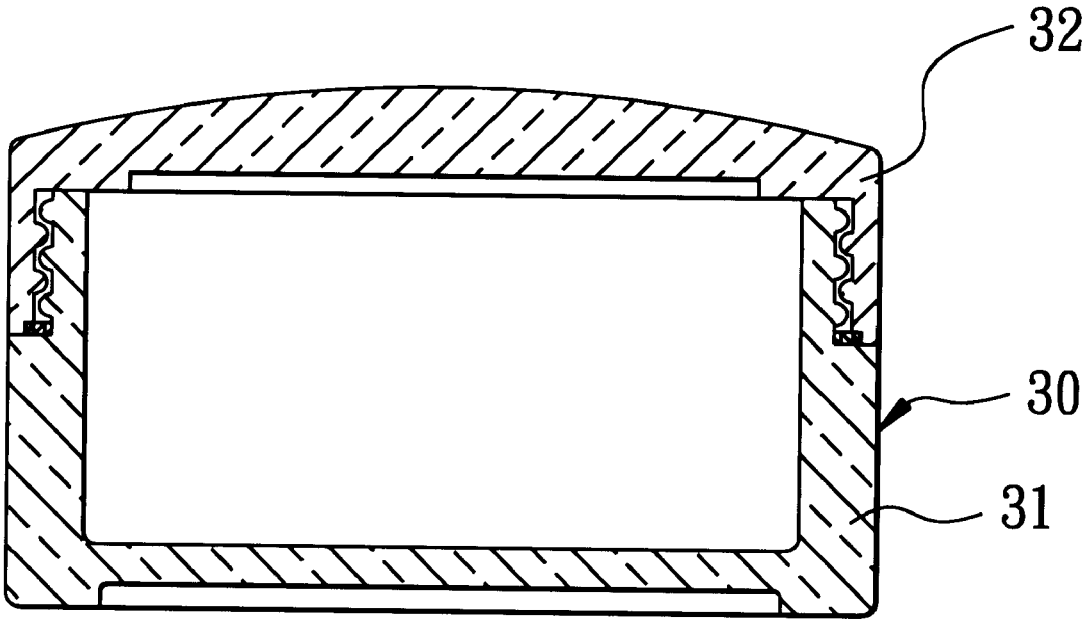
FIG. 7 is a sectional view of the third preferred embodiment of a cosmetic container according to the present invention.

FIG. 7 shows a third preferred embodiment of a cosmetic container 30 of the present invention which is generally similar to the previous embodiments in structure except that the container body 31 and the cover assembly 32 are rectangular in cross section.

Figure 8:
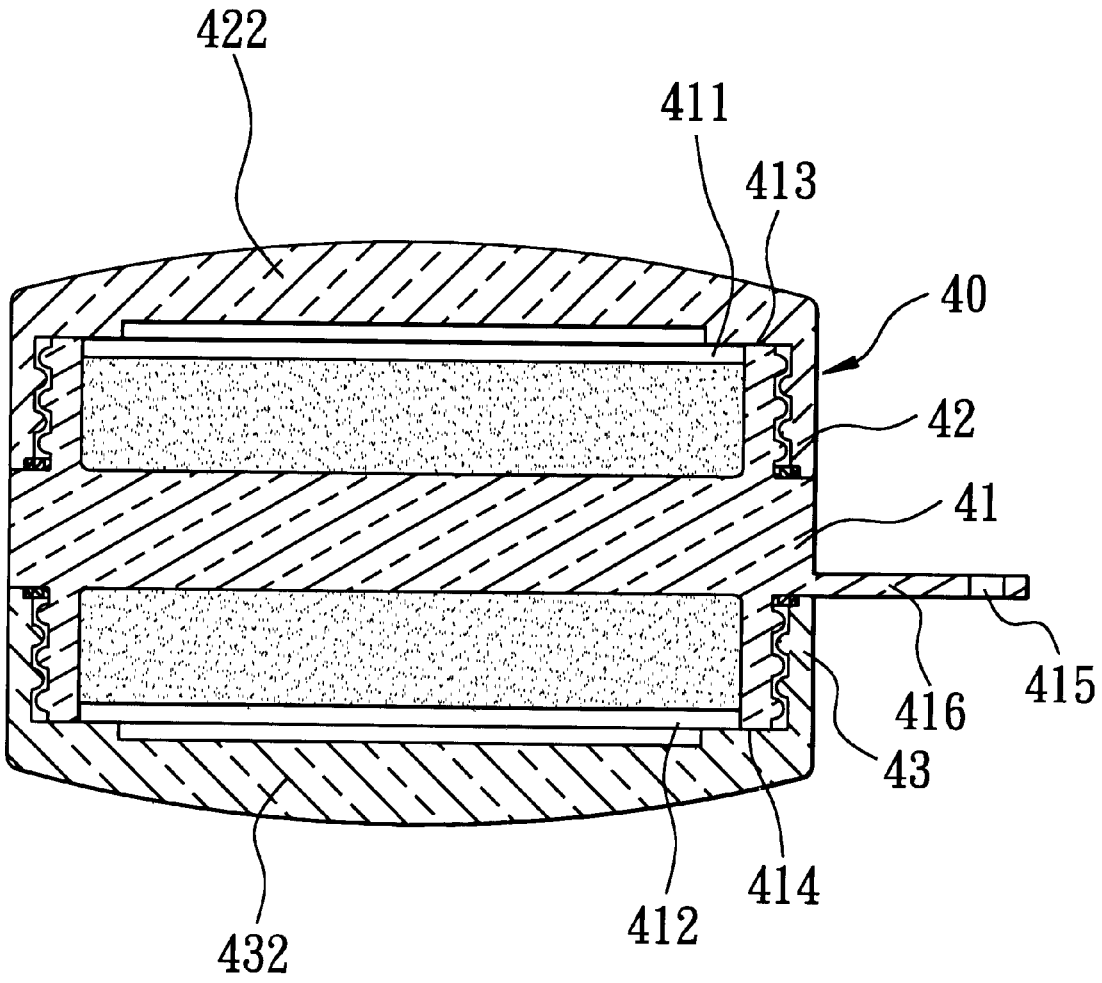
FIG. 8 is a sectional view of the fourth preferred embodiment of a cosmetic container according to the present invention.

Referring to FIG. 8, in a fourth preferred embodiment of a cosmetic container 40 of the present invention, the container body 41 has two opposite side surfaces 413, 414. The chamber unit includes two chambers 411, 412 that are formed respectively in the side surfaces 413, 414 of the container body 41. The cover body unit includes two annular cover bodies 42, 43 that are attached respectively and threadedly to the side surfaces 413, 414 of the container body 41. The magnifying glass unit includes two magnifying glasses 422, 432 that are secured integrally and respectively within the cover bodies 42, 43. The chamber unit is preferably provided with a radially and outwardly extending projection 416 which has a mounting hole 415 formed therethrough for mounting purposes.

With this invention thus explained, it is apparent that numerous modifications and variations can be made without departing from the scope and spirit of this invention. It is therefore intended that this invention be limited only as indicated in the appended claims.

I claim:

1. A cosmetic container comprising:

a container body having a chamber unit that is formed therein and that is adapted to receive cosmetic substances therein; and a cover assembly mounted removably on said container body so as to close said chamber unit, said cover assembly having a cover body unit and a magnifying glass unit that is attached to said cover body unit and that is adapted to form enlarged images of the cosmetic substances thereon, wherein said container body has two opposite side surfaces, said chamber unit including two chambers that are formed respectively in said side surfaces of said container body, said cover body unit including two annular cover bodies that are attached respectively to said side surfaces of said container body, said magnifying glass unit including two magnifying glasses that are secured respectively within said cover bodies.

* * * * *